US005648635A

United States Patent [19]

Lussier et al.

[11] Patent Number: 5,648,635

[45] Date of Patent: Jul. 15, 1997

[54] EXPENDALBLE CHARGE CASE HOLDER

[76] Inventors: Norman Gerald Lussier, 203 Oakside Road S.W., Calgary, Alberta, Canada, T2V 4H7; Michael Norman Lussier, 206 Mount Lorette Close S.E., Calgary, Alberta, Canada, T2Z 2L6

[21] Appl. No.: 517,674

[22] Filed: Aug. 22, 1995

[51] Int. Cl.[6] ..... F42B 1/02; F42B 3/00

[52] U.S. Cl. ..... 102/307; 102/312; 102/313; 102/331; 175/4.6; 299/13

[58] Field of Search ..... 102/307, 312, 102/313, 331; 175/4.6; 166/299; 299/13

[56] References Cited

U.S. PATENT DOCUMENTS

| | | | |
|---|---|---|---|
| 2,358,795 | 9/1944 | Djidies et al. | 102/24 |
| 3,253,653 | 5/1966 | Layne, Sr. | 166/63 |
| 4,326,462 | 4/1982 | Garcia et al. | 102/310 |
| 4,598,775 | 7/1986 | Vann et al. | 175/4.6 |
| 4,609,057 | 9/1986 | Walker et al. | 175/4.6 |
| 4,621,396 | 11/1986 | Walker et al. | 29/1.3 |
| 4,655,138 | 4/1987 | Regalbuto et al. | 102/307 |
| 4,716,833 | 1/1988 | Regalbuto | 102/320 |
| 4,726,431 | 2/1988 | Oestreich et al. | 175/4.6 |
| 4,739,707 | 4/1988 | Regalbuto et al. | 102/307 |
| 4,747,201 | 5/1988 | Donovan et al. | 29/433 |
| 4,800,815 | 1/1989 | Appledorn et al. | 102/321 |
| 4,915,029 | 4/1990 | Appledorn et al. | 102/310 |
| 4,951,744 | 8/1990 | Rytlewski | 175/4.57 |
| 5,542,480 | 8/1996 | Owen et al. | 175/4.51 |
| 5,564,499 | 10/1996 | Willis et al. | 166/299 |

*Primary Examiner*—Peter A. Nelson
*Attorney, Agent, or Firm*—John C. Hunt

[57] ABSTRACT

This invention is in the field of perforating gun systems used, for example, to gain access to underground oil and gas formations. In particular, this invention relates to an expendable holder assembly for shaped charges of such systems.

37 Claims, 11 Drawing Sheets

EXPENDALBLE CHARGE CASE HOLDER

BACKGROUND OF THE INVENTION

Installation of an oil or gas well involves fixing a tubular steel casing in cement in an underground bore. Holes must be subsequently created in the steel casing and cement in order to gain access to the surrounding formation, i.e., oil or gas deposit. Such holes are generally created through a process known as perforation. A well may also be required to be re-perforated from time to time if, for example, the flow of oil or gas becomes impeded by debris.

Perforating gun systems have been in use for or many years. A gun generally contains several explosive charges spaced from each other. There is a detonation cord running between and connected to the charges. The charges are generally arranged along the length of the gun to explode radially outwardly in different directions into the formation. A charge is contained in a case having an interior cavity shaped to deliver explosive forces to the desired degree of penetration into the formation and is thus referred to as a shaped charge.

Until a few years ago, "port plug guns" were commonly used and are still in use today, although less so. Such a gun includes a hollow tube having a wall thickness of between about 1.3 and 1.9 cm (½" and ¾"), there being threaded holes or ports spaced along the tube. A shaped charge is inserted into the open end of the gun to the location of each port of the tube and secured in the tube by a port plug threaded into the port. After detonation, the gun is withdrawn from the well hole, the plugs and other remnants removed and the tube reloaded to be used again.

In order to increase charge density available for a particular gun, given the limits of the outer diameter of the gun, there has been a trend to systems having guns with thinner walls. The greater internal volume of gun tubes having thinner walls permits an increase in charge density. Thin-walled gun tubes, however, are less resistant to explosive forces and must be discarded after only one use.

It is not possible to thread the ports in thin walled tubes and threaded port plugs therefore are not used to secure charges in the thin walled tubes. At least two different approaches to holders for shaped charges have been patented. U.S. Pat. No. 4,598,775, of Vann et al., issued in July 1986 for Perforating Gun Charge Carrier Improvements. A charge holder is made up of a number smaller triangular holders connected together in tandem, each of the smaller holders being loaded with three shaped charges. U.S. Pat. No. 4,800,815, of Appledorn et al., issued in January 1989 for a Shaped Charge Carrier. In this case, a thin walled seamed tubular holder (referred to as a carrier in the specification of the Appledorn patent) has diametrically opposed tabs that are bent by means of a screwdriver down onto a surrounding upper lip of a shaped charge, diametrically opposed rear portions of the lip (at 90° to the tabs) being supported by portions of the tube. The disclosures of these two issued United States patents are incorporated herein by reference.

At least as known to the inventor, the most common current approach to securing a shaped charge case in a thin walled tubular holder is to use a charge case that has a small leg extending downwardly from its base. The holder is manufactured with a small hole, diametrically opposite each larger port, through which the leg of the casing is inserted to protrude to the exterior of the holder. A clip is attached to the protruding leg to secure the casing in the charge holder and to hold the detonation cord in place. To be effective, the detonation cord has to be in appropriate contact with detonation material located in an aperture in the center of the base of the charge case.

This current approach has produced satisfactory performance in the field but the charge cases are machined and this is expensive,

GENERAL DESCRIPTION OF THE INVENTION

In one aspect, the present invention is an expendable shaped charge holder for a perforating gun. The holder is a thin-walled tube having an aperture for a shaped charge for installation in the tube by insertion through the aperture. There is a plurality of fingers unitary with the tube wall protruding into the tube interior with surfaces which together define a cavity for receipt of the case of the charge. The surfaces of the fingers engage the case when brought into abutting contact with the fingers so that the fingers support the installed charge in the holder.

Generally, the tube includes at least one tab associated with the aperture and unitary with the tube wall. The tab has an end attached to the tube wall and is bendable by means of a hand-held tool into abutting contact with an upper rim of the case of the installed charge to affix the charge in the tube.

Usually, the tube has a longitudinal axis and there is a plurality of apertures spaced from each other.

In a particular embodiment, the invention is an assembly of the tube and shaped charges. There is a detonation cord and the fingers are shaped to locate the base of the charge case with respect to an interior wall of the tube to provide a gap for locating the detonation cord in a position with the cord in operable contact with the initiator of the charge.

It is possible to have an assembly in which the tube has a plurality of apertures spaced along an axis of the tube. In such an instance there is a plurality of the fingers, a least one tab and a shaped charge corresponding to each aperture. It is preferred in one embodiment to have the points of attachment of the fingers to the tube wall of each plurality or array of fingers to be spaced from each other and to provide a path for the detonation cord. The path can be oriented for stringing the detonation cord between neighboring charge locations by appropriate spacing and orientation of the fingers.

In one embodiment, it is most preferred to have the fingers shaped to locate the base of the charge such that when the tab is bent into abutting contact with the upper rim of the case the base of the case exerts compressive force on the cord to secure the cord in its position against the interior of the tube wall.

There can be an array of four fingers for each charge, members of a first pair of the fingers being aligned with each other, and a members of a second pair of the fingers being aligned with each other and forming an angle of about 90° with the first pair.

It is possible to have a tube that is of circular cross section. Each aperture can be shaped to matingly receive its shaped charge. In a particular embodiment, the fingers of a given array of fingers are shaped to support the charge in a position with an upper rim of the case of the charge intermediate a portion of an edge of the aperture lying on an aperture diameter line parallel to a longitudinal axis of the tube and a portion of the aperture edge lying on an aperture diameter line orthogonal to the axis of the tube. The tab can have a first edge which defines an edge portion of the aperture and the tab can be circumferentially located along the perimeter of the aperture to permit bending of a free end of the tab into abutting contact with the upper rim of the charge case.

In situations where each charge case has a circular external transverse section and the base of the case has a surrounding wall slanted downwardly and inwardly, each finger of each array of fingers can have a distal portion, which distal portions together define surfaces to abut the wall of the base of the charge case fitted into the tube. Further, each finger can have an intermediate portion connecting the distal portion to the tube wall. The intermediate portion can be arranged to form a first internal angie with the tube wall while the distal portion forms a second internal angle with the tube wall With the first angle being greater than the second angle.

In a particular aspect of the invention, the tab has an edge which defines an edge portion of the aperture. The tab can be configured for situations in which a rim portion of an installed charge case is intermediate the cavity and the point of attachment of the tab. The unattached end of the tab thus can have a notch located to permit a first edge of the tab defining the notch to be brought into abutting contact with the upper rim of the charge case when the tab is bent about its point of attachment towards a central axis of the tube so as to affix the charge case against radially outward movement with respect to the tube. A second edge of the tab can be oriented to abut a side of the charge case when the first edge is in abutting contact with the rim of the case. There can be one, two or more tabs for each aperture. There can be a pair of tabs where each tab is located to have an end attached to the tube lying on a diameter line of the aperture parallel to the axis of the tube.

In a particular embodiment of the invention, there is an assembly including a detonation cord where the fingers are shaped to support the cord between the fingers and case so as to locate the cord in operable contact with the initiator of the charge.

It is possible to have a the tube having a central axis and a plurality of apertures axially spaced apart along the tube and a plurality of fingers corresponding to each aperture. The fingers of each of the pluralities of fingers can be shaped to hold the case received through the corresponding aperture in a position in which the base of the case protrudes radially inwardly past the axis of the tube and to permit a detonation cord to be inserted between the fingers and the initiator of the charge. The axial spacing of the apertures and phasing of the apertures can be such that a cord can be so inserted between each plurality of fingers and the corresponding case to be strung between neighboring cases through the tube and tensioned into operable contact with the initiator of each charge.

It is possible to have charges which are circular in transverse outer cross section and to have each aperture shaped to receive such a charge. There can be first and second fingers of each plurality of fingers located on diametrically opposite sides of their corresponding aperture and extending from an edge of the aperture into the tube. Further, there can be third and fourth fingers in the plurality of fingers located in the tube diametrically opposite the corresponding aperture and projecting into the interior of the tube toward the aperture. More particularly, each first finger can be located on an aperture diameter line parallel to the axis of the tube and there can be two second fingers, one on either side of the first finger and on a line parallel to the aperture diameter line. The third and fourth fingers can be aligned with each other on a line transverse to the tube axis to affix the charge case against movement in a direction transverse to the axis of the tube.

In a particular embodiment, the plurality of fingers includes a pair of fingers located in the tube diametrically opposite the aperture and projecting into the interior of the tube toward the aperture. Each of the pair of fingers has a proximal end connected to the tube wall and a distal end for abutting contact with the case of the charge and a portion of each of the fingers, between the distal and proximal ends of the finger, together with the portion of the other finger and with a lower surface of the installed charge case, defines a gap for receipt of the cord to locate the cord in operable contact with the initiator of the charge. It is possible to have a portion of each finger with a surface spaced from the lower surface of the charge case to hold the detonator cord against the lower surface of the charge case.

Where the tube is of circular cross section and the aperture is shaped to receive a charge having a case with a transverse circular cross section such that an upper rim of the installed charge case is positioned intermediate the portion of the aperture edge lying on an aperture diameter line parallel to the axis of the tube and the portion of the aperture edge lying on an aperture diameter line orthogonal to the axis of the tube the tab can have an edge defining a portion of the edge of the aperture and which is circumferentially located to permit bending of a free end of the tab inwardly toward the center of the aperture into abutting contact with the upper rim of the charge case.

There can be an aperture between the tab and the tube wall to permit insertion of a screw driver into the aperture for bending the tab into abutting contact with the upper rim of the case.

In the case of a tube having a central axis in which the tube is dimensioned and the fingers shaped such that at least a portion of an upper rim of the case of the installed charge is located radially inward of the tube wall, the tab can have a free end and be located to permit a first edge of the free end to be brought into abutting contact with the upper rim of the charge case when the free end of the tab is bent towards the center of the tube. The free end of the tab can have a second edge oriented to abut a side of the charge case when the first edge is in abutting contact with the rim of the case.

Where the tube is of circular cross section and has a central axis and there is a plurality of apertures with a plurality of fingers, a tab and a shaped charge corresponding to each aperture, and each of the apertures is shaped to matingly receive the corresponding shaped charge, the fingers of each plurality of fingers being shaped to support the corresponding charge in a position with an upper rim of the case of the charge intermediate a portion of an edge of the aperture lying on an aperture diameter line parallel to the axis of the tube and a portion of the aperture edge lying on an aperture diameter line orthogonal to the axis of the tube, the corresponding tab can have a first edge which defines an edge portion of the aperture and the tab can be circumferentially located to permit bending of a free end of the tab into abutting contact with the upper rim of the charge case. Further, the unattached end of each tab can define a notch including the first edge and the first edge can be located to be brought into abutting contact with the upper rim of the charge case when the tab is bent about its point of attachment to the tube wall towards a central axis of the tube. Each such notch can include a second edge oriented to abut a side of the charge case when the first edge is in contact with the rim of the case. The point of attachment of each such tab can lie on a diameter line of the aperture parallel to the axis of the tube. There can be two such tabs corresponding to each aperture.

In a preferred assembly there is a detonation cord and the tube has a central axis and three apertures circumferentially spaced from each other and lying in a common plane orthogonal to the axis. There is a plurality of the fingers corresponding to each aperture. The fingers of each plurality can be shaped to support a corresponding installed charge in the holder such that the charges are spaced from each other to provide a gap between the bases of the cases for receipt of the detonation cord into the gap and in operable contact with the initiators of the three cases.

In such instance, the tube can be of circular cross section with each of the apertures shaped to matingly receive its shaped charge. The diameter of the tube can be dimensioned and the fingers of each plurality of fingers shaped to support the charge corresponding to each aperture in a position with an upper rim of the case of the charge intermediate a portion of an edge of the aperture lying on an aperture diameter line parallel to the axis of the tube and a portion of the aperture edge lying on an aperture diameter line orthogonal to the axis of the tube, and the corresponding tab can have a first edge which defines an edge portion of the aperture and the tab can be circumferentially located to permit bending of a free end of the tab into abutting contact with the upper rim of the charge case.

An assembly can be such that the charges are affixed in the tube without relying on a machined portion of the case of the charge.

The charge cases can be cold formed metal, formed of powdered metal, cast metal, fiber material, glass, or a paper product. The case can be manufactured free of machined portions. In disclosed embodiments, the charge case is cold formed metal.

The tube is preferably of metal. Most preferably the tube is of extruded steel of constant thickness and constant cross section.

In a particular embodiment the invention is an expendable shaped charge holder assembled with shaped charges for use as part of a perforating gun. There is a thin-walled metal tube having an aperture and a shaped charge received in the tube through the aperture. There is a plurality of fingers unitary with the tube wall protruding into the tube interior with surfaces which together define a cavity in which an outer case of the charge is seated and which are in abutting contact with the case to engage the case and support the charge installed in the holder. There is a tab unitary with the tube wall and having an end attached thereto, a surface of the tab being in abutting contact with an upper rim of the case of the installed charge to affix the charge in the tube.

In preferred embodiments, the fingers and tabs are formed from the tube wall by laser cutting, plasma cutting, sand cutting, or punching of the tube wall.

BRIEF DESCRIPTION OF DRAWINGS

In FIG. 1*a* the gun is delivered by a wire line and in FIG. 1*b* the gun is delivered by production tubing;

DESCRIPTION OF PREFERRED EMBODIMENTS

Figure 1B:
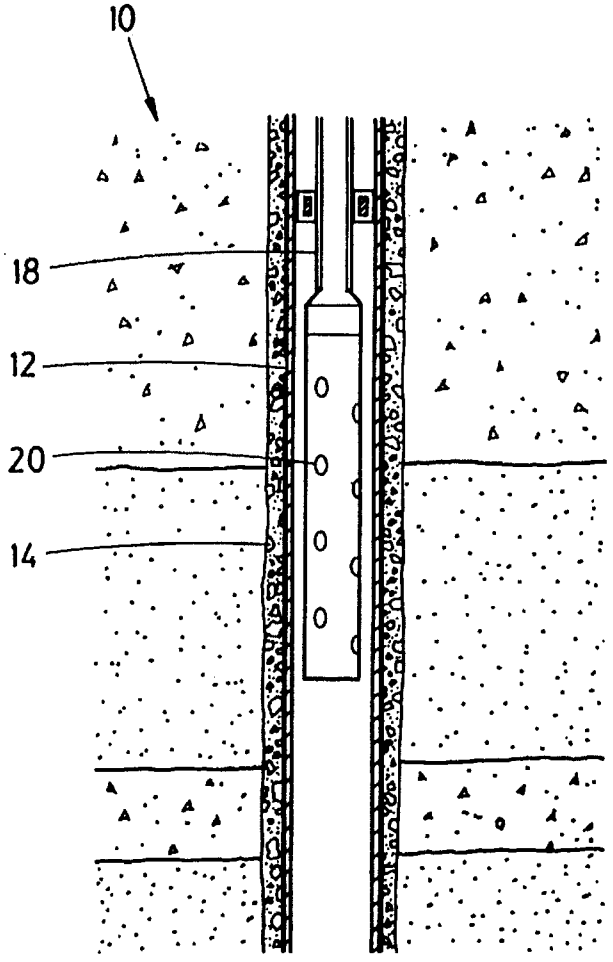
FIGS. 1*a* & *b* show, in partial section, an oil well having a perforating gun located therein.
Figure 1A:
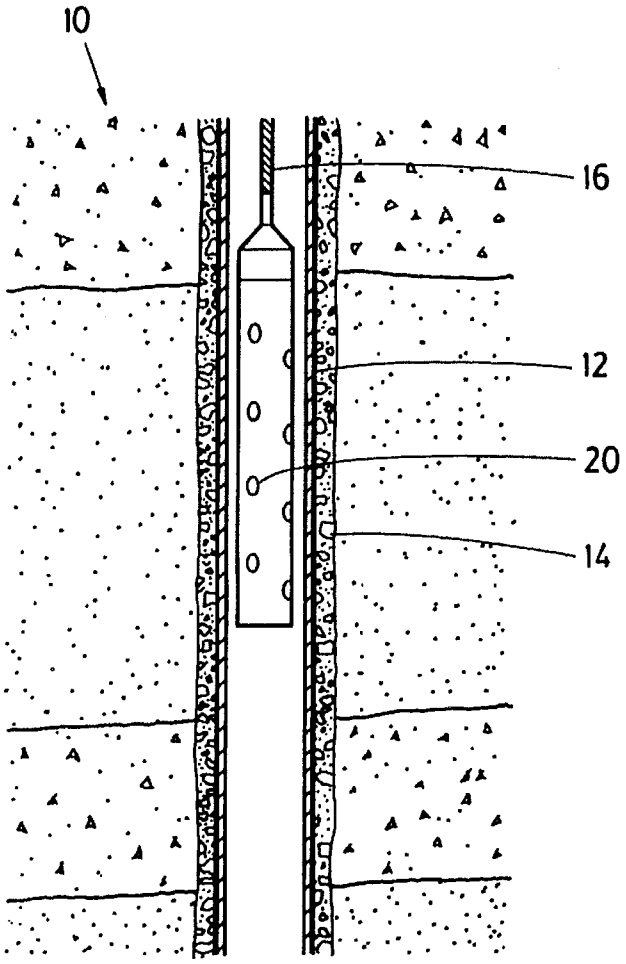

Turning to the drawings, FIGS. 1*a* and 1*b* show a general arrangement of an oil or gas well 10 having a perforating gun located therein. The well includes a conventional well casing 12 surrounded by cement 14. In FIG. 1*a*, the gun is suspended in the well by wire line 16, while in FIG. 1*b* the gun is delivered into the well by production tubing 18. Location of charges 20 are indicated schematically as the charges are located longitudinally spaced apart from each other.

Figure 2B:
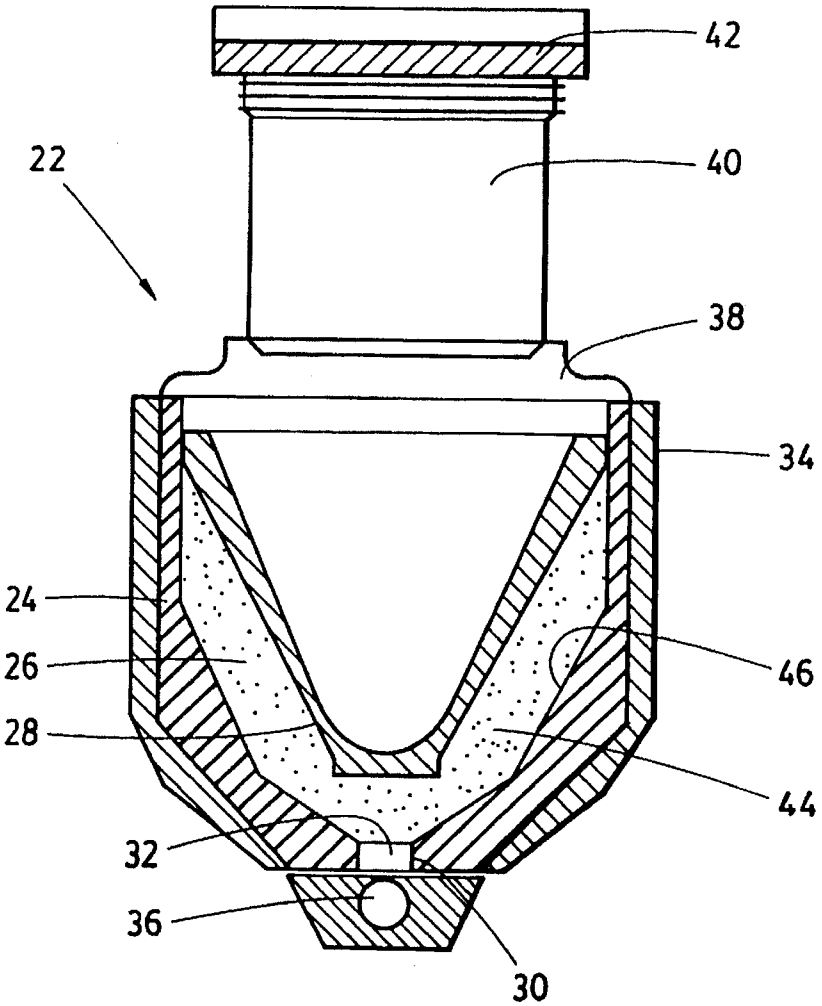
FIG. 2*b* shows the case with accessories for use in a port plug gun.
Figure 2A:
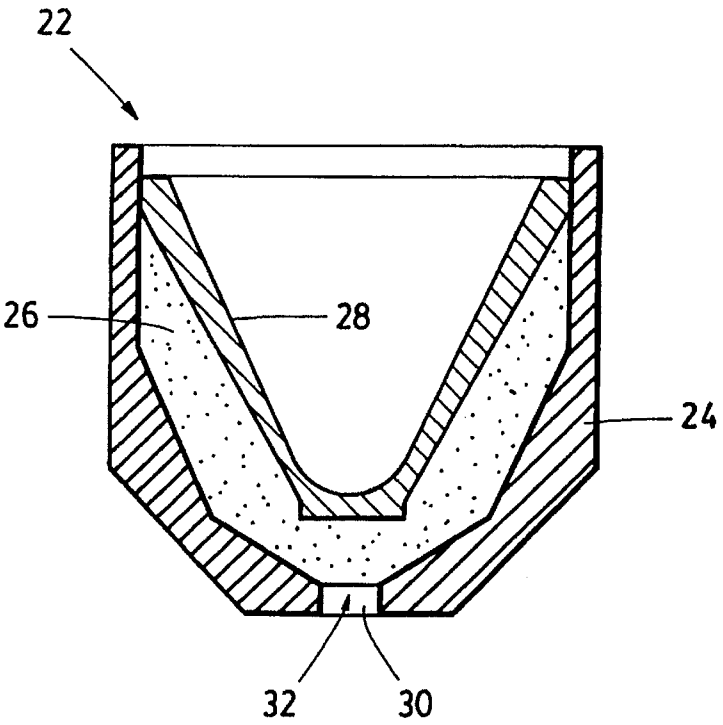
FIG. 2*a* shows, in longitudinal section, a conventional cold formed charge case.

FIGS. 2*a* and 2*b* show a typical shaped charge 22 having a cold formed charge case 24. Located in charge case 24 is explosive 26, which is held in the case by liner 28. Initiator material 30 is located in aperture 32 in the base of the case. In FIG. 2*b* are shown accessories typically used in installing the case in a conventional port plug guns: rubber jacket 34 which includes initiation cord holder hole 36, washer 38, alignment sleeve 40, and threaded port plug 42.

The shape of a charge is determined by shape of cavity 44 defined by interior wall 46 of case 24, for example. The shape of the case can be varied to obtain the cavity shape required, as understood by those skilled in the art. In this specification, it is to be understood that the term "shaped charge" refers to a charge case, such as the one illustrated in FIG. 2*a*, its explosive and liner.

Figure 3B:
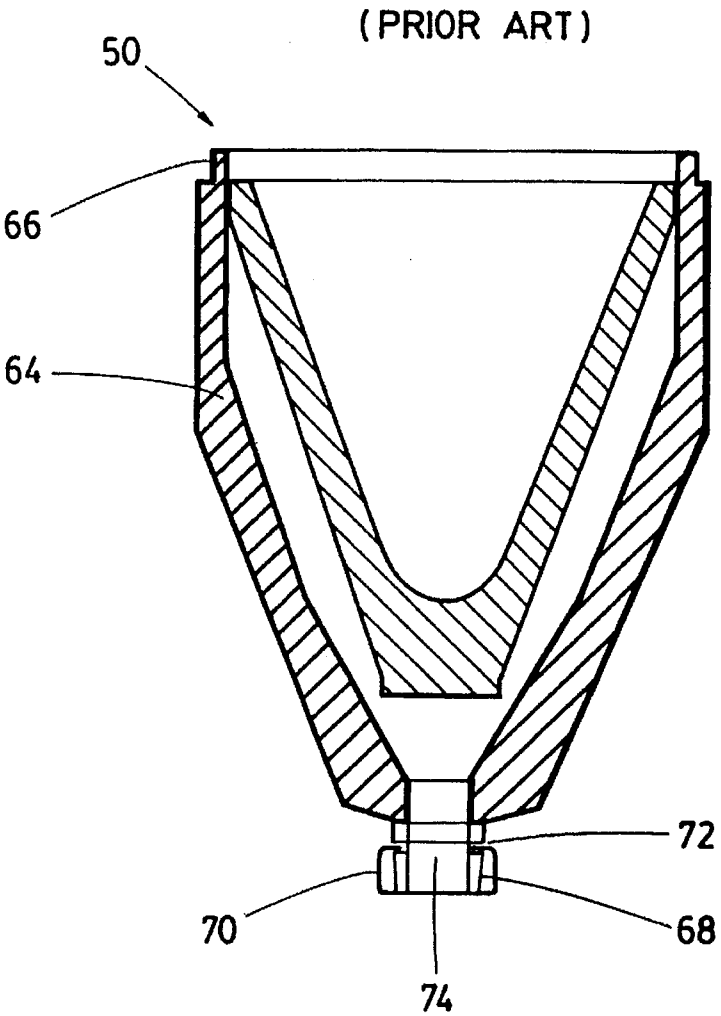
FIG. 3*a* & 3*b* show, in longitudinal section, first and second representative prior art machined charge cases for use with an expendable charge holder.
Figure 3A:
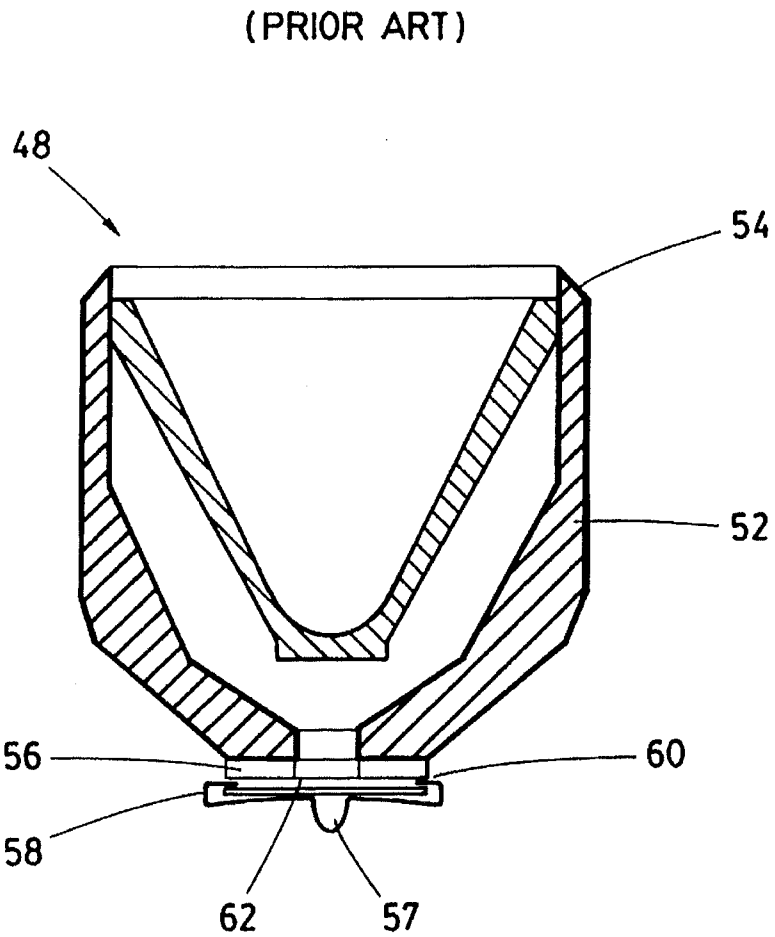

FIGS. 3*a* and 3*b* show two shaped charges 48, 50 which are typical of those currently used in expendable holders. As can be seen in FIG. 3*a*, shaped charge 48 includes charge case 52 having machined exterior portions 54, 56. Lower leg 57 projects downwardly from the base of the charge case so that the case can be installed in a tube holder by insertion of the leg through an aperture in the holder and secured thereto by clip 58 received in machined groove 60, an initiation cord (not illustrated) having been received into space 62 As can be seen in FIG. 3*b*, shaped charge 50 includes charge case 64 having machined exterior portions 66, 68. Leg 68 projects downwardly from the base of the charge case 64 so that the case can be installed in a tube holder by insertion of the leg through an aperture in the holder and secured thereto by clip 70 received in machined groove 72, an initiation cord (not illustrated) having been received into space 74.

First embodiment shaped charge holder 76 of the present invention is illustrated in FIGS. 4 to 7. Holder 76 is suitable for use with conventional cold formed charge cases such as charge case 24. The charge holder tube includes apertures 78 each of sufficient diameter for case 24 to be inserted into the tube. Tube holder apertures of the illustrated embodiments are referred to as circular, as they appear in plan view (i.e., FIG. 5) since they are matchingly shaped to receive charge cases that are circular in transverse cross section. Located generally opposite to each aperture 78 is an array of fingers 80 which protrude into the hollow of the tube to define a cavity 82 for receipt of the base 84 of case 24 of the shaped charge thereinto. In the illustrated embodiment there are four fingers 80 arranged in a petal-like fashion, The center of each array of fingers is located on an imaginary axis 86, orthogonal to the tubing wall and which passes through the center of the aperture associated with that array. Put another way, each finger lies on a ray extending from a point located concentrically with respect to the aperture in the opposing wall of the tube.

Each of fingers 80 is angled at 90° with its nearest neighbors. Fingers 88 are aligned with each other and offset from the axis of the tube 90 by an angle 92 of about 15°. Fingers 94 are aligned with each other and make an angle 96 of about 15° with axis 98 perpendicular to the longitudinal axis of the tube. The points of attachment of the fingers to the tube wall of each array of fingers are spaced from each other and the fingers are oriented with respect to a central axis of the tube to provide a path along the tube wall at the center of the array. The path located between the points of attachment of the fingers is oriented for stringing the detonation cord between neighboring charge locations. While this particular arrangement has been found suitable for convenient positioning of detonation cord 100 during assembly of the charges into the tubular holder, other suitable arrangements of fingers are certainly possible.

Case 24 is affixed against outward radial movement from the tube by tabs 102. Each tab 102 is located such that one of its ends is attached to the tube at a point lying on the diameter line 104 of the aperture parallel to the axis of the tube. An edge 106 of tab 102 forms a portion of the edge of the aperture prior to bending of the tab into place with respect to an installed charge case. Tab 102 has a notch defined by surfaces 108, 110. Surface 108 is generally parallel to the axis of the tube and is located such that when the free end of the tab is bent radially inwardly toward the central axis of the tube, surface 108 is brought into abutting contact with upper edge 112 of the rim of the charge case in its installed location to affix the case from withdrawal from the tube (that is withdrawal in a radially outward direction with respect to the central axis of the tube). With both of tabs 102 bent into position with surfaces 110 in abutting contact with side wall 114 of the charge case, the charge case is affixed also against axial movement with respect to the tube.

Figure 7:
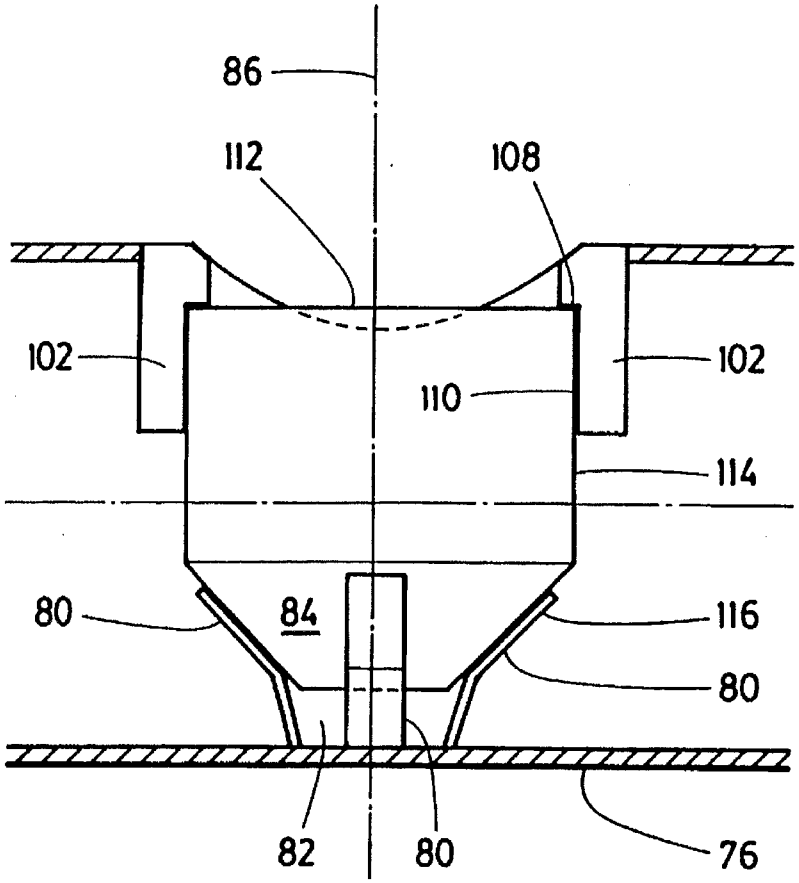
FIG. 7 is a simplified sectional view taken of the first embodiment holder tube taken along 7—7 of FIG. 6.
Figure 6:
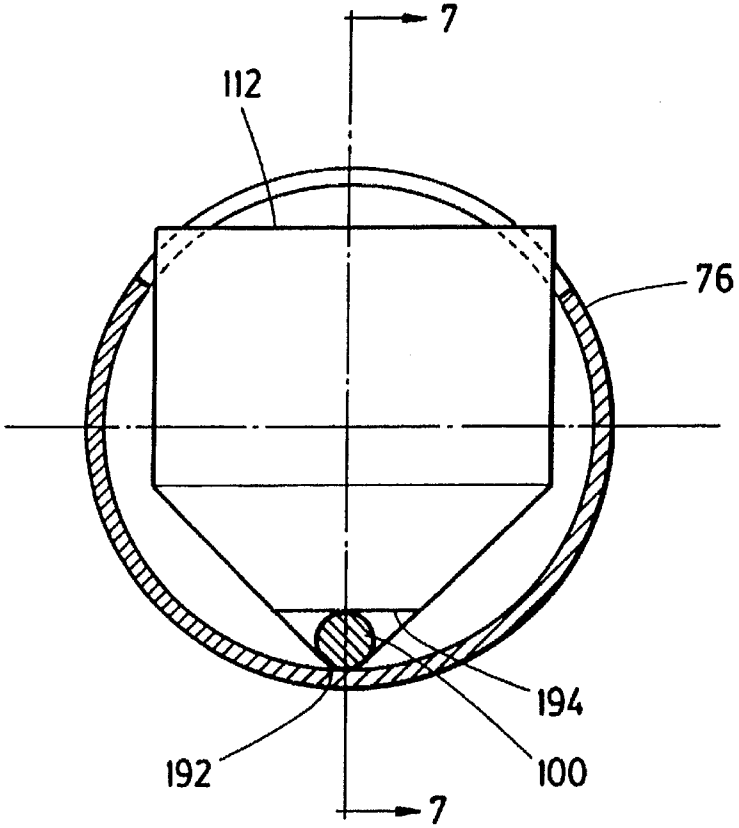
FIG. 6 is a simplified sectional end view of the first embodiment holder tube taken along 6—6 of FIG. 5 and showing a seated charge casing in its holder tube.

As can be seen in FIG. 7, interior walls 116 of the distal regions of the fingers are angled to more or less match the angle of the exterior of base 84 of the case seated in the cavity defined by the fingers. The base of case 24 is a truncated cone, the angle between opposite exterior surfaces of the curved wall of the cone being about 90°, as can be seen in FIGS. 3*a* and 3*b*. Case 24 is illustrative of those available or that could be manufactured and used with a charge holder of the present invention. The shape of the base of the case could vary and of course the angle between opposing base walls could vary. The shape of the base depends somewhat on the shape of charge required for a particular application (i.e., the shape of the interior of the case). Accordingly, the shape and angle of the fingers of the holder can be varied from those illustrated to be suitable for use with a case having a base different from that of case 24.

Fingers 80 are formed in the tubing wall of the carrier by a laser cut. The fingers are then bent into the configuration shown. Tabs are cut at the factory. Once a charge case is inserted into the tube, tabs 102 are bent into place using a cotter pin tool as required, the tube and charges typically being assembled on site. The fingers and tabs are formed in the tubing wall and as such are unitary with the tube wall. The tube is a single piece of metal and the fingers and tabs are formed as part of the same single piece. It may be advantageous to coat or treat surfaces of the fingers that abut a charge case with an adhesive or a relatively high friction material. Tabs might be similarly modified.

A holder and charges are generally assembled together in the field. To assemble a case into a tube, the tube is placed in a horizontal position with the aperture to be loaded directed upwardly. The detonation cord (primacord), which runs from end to end of the tube, is placed through the center of the array of fingers and the charge case inserted through the aperture. The arrangement is such that the initation material, or intitiator, of the case and the cord are properly located with respect to each other. The cotter pin tool is then used to bend the tabs into place and cord 100 is pressed between the bottom surface 194 of the charge case and a portion 192 of the interior of the tube wall to be in operable contact with the initiator.

As is the practice in the industry, the tube of the first embodiment holder can be anywhere between 0.5 and 10 meters in length. In the case of the first embodiment illustrated, the tube is of thin walled extruded steel, being of substantially constant cross section and substantially constant thickness, having a thickness of about 0.17 cm (0.065 inches) and has an external diameter of about 4.76 cm (1.875 inches). Such material has been found to have sufficient resilience to permit the deformation or bending of finger and tab portions of the holders described herein. Other thicknesses of metal could possibly be used, say in the range from about 0.010 inches to about 0.25 inches.

Neighboring apertures are axially spaced from each other with their center points about 3 inches apart, measured as they project onto the central lengthwise axis of the carrier. Each aperture is circular when projected onto a flat surface (as is the case in FIG. 5) and the projected circle has a diameter of about 3.61 cm (1.42 inches) in order to accommodate the charge case, which has a circular cross-section with an outer diameter of about 3.58 cm (1.41 inches).

Apertures 78 as shown were laser cut into the tube, but other methods of formation known to those skilled in the art, such as plasma or sand cutting, or punching, etc., could be used.

The spacing of apertures along the holder is set to minimize interference between shock waves when the charges are detonated. In the illustrated embodiment, the apertures are centered on an imaginary helix running along the outer curved cylindrical surface of the tubing such that the central axis of each aperture forms 90° with that of its neighbor. This is referred to as 90° phasing of the apertures. As is practiced in the industry, apertures of a shaped charge tube holder of the present invention could just as well have 30°, 60°, 120°, or 150° phasing, or other degrees of phasing, as required for a particular application.

The fingers of the preferred embodiments are formed initially in the tubing wall by laser cutting. The length and width of each finger of the first embodiment as cut from the metal are about 1.85×0.53 cm (0.73×0.21 inches) while the length from the distal tip of one finger to the distal tip of the opposing (i.e., aligned) neighbor is about 5.0 cm (1.97 inches). Bending of the fingers into place is accomplished by conventional stamping processes known to those skilled in the art, in order to obtain the desired shape and configuration for supporting a case of a particular shape and dimension in the carrier.

In the case of the first embodiment, it is possible to obtain charge densities of 14, 17 and 20 shots per meter, this measure being the number of charge cases per meter length of the tube that can be installed in the holder.

The number of fingers, their precise orientation, shape and dimensions could be varied somewhat. It may be possible to use as few as two fingers. In such case, it might well be desirable to more closely conform the shape of the fingers to the shape of the charge case base, i.e., to matchingly curve the fingers to the curvature of the base of the charge case. Widening the fingers somewhat might also be desirable.

The shaped charge illustrated in FIG. 2*a* includes the case (with initiation hole), explosives, and liner, and is ready for installation as into the carrier, as previously described. The charge is of a conventional type widely commercially available and well known to those skilled in the art.

Figure 4:
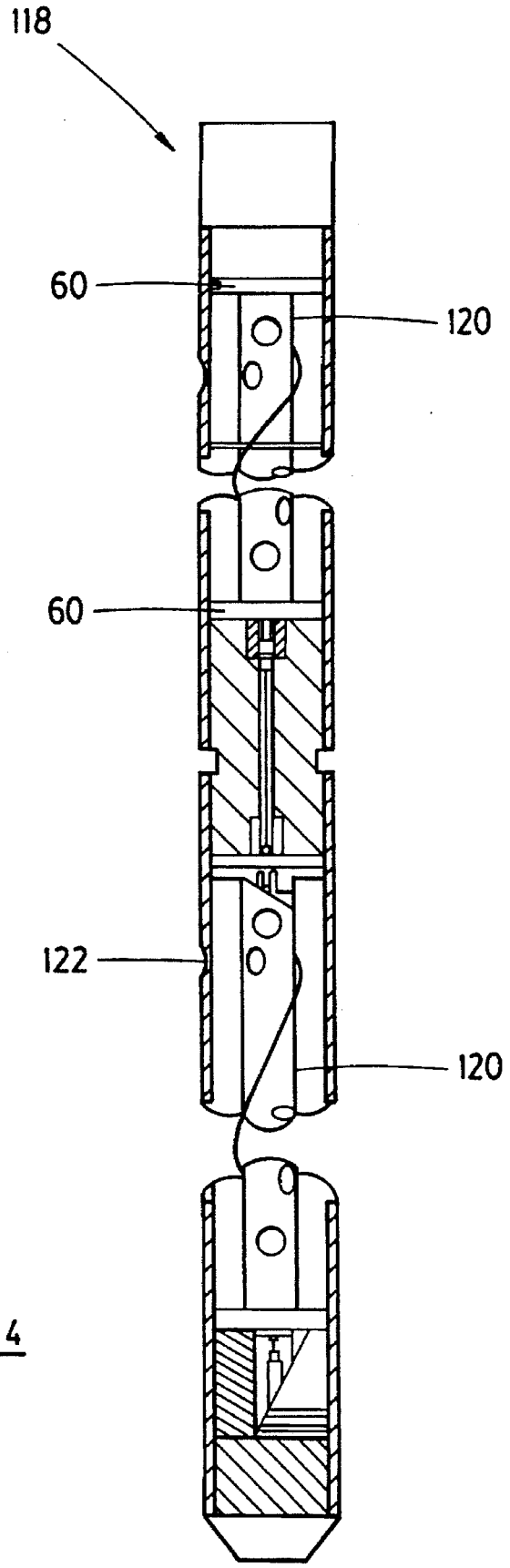
FIG. 4 shows an expendable perforating gun system in partial section incorporating two charge holder tubes of the present invention in a tandem arrangement.
Figure 5:
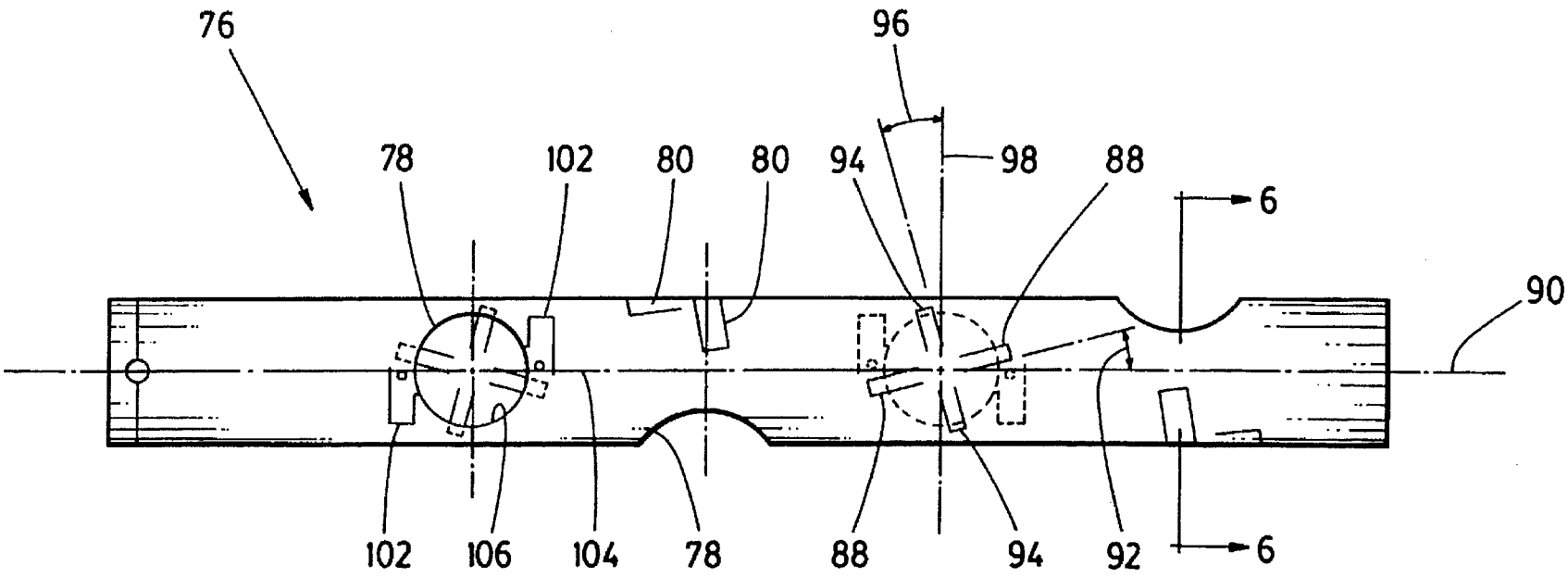
FIG. 5 is an elevational side view of a first embodiment holder tube.

FIG. 4 illustrates a fully assembled gun perforating system 118 having charge tubes of the present invention connected in tandem, such a tandem arrangement being common practice in the industry. Each charge holder assembly is enclosed in a carrier 120 having scalloped or thinned areas 122. The thinned areas are located to be directly in the path of explosive forces when the gun is activated in order to give way during the explosion. Alignment ring 60 ensures that the thinned areas and apertures of the assembly are properly aligned.

Figure 11:
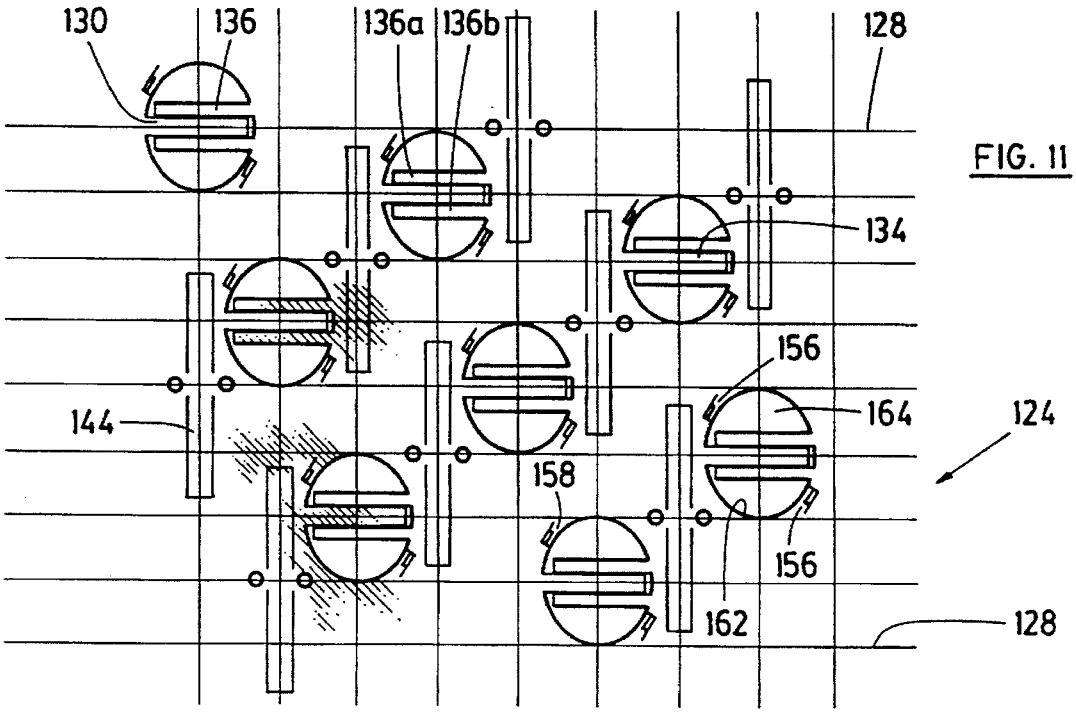
FIG. 11 is a representational projection of the second embodiment holder tube onto a flat surface showing the cuts of the tube prior to bending of fingers into position.

A second embodiment charge holder 124 is illustrated in FIGS. 8 to 11. The outer diameter of tube 126 in this instance is about 7.6 cm (3 inches). In the illustrated arrangement there are there are twenty-six charges per meter length of the holder with 135° phasing and a distance of about 3.8 cm (1½ inches) between the centers of neighboring apertures. FIG. 11 shows the holder projected onto a flat surface, having various elements cut into it but not yet shaped into place. Lines 128 are lines of intersection of the imaginary longitudinal edges of the tube.

The second embodiment holder includes two different types of fingers protruding into the tube interior to support a charge case. There is a first pair of fingers 130, 136. Finger 130 is located on an aperture diameter line 134 parallel to the axis of the tube. Finger 136 is made up of two similar fingers, 136*a* 136*b* one on either side of finger 130, and being parallel thereto. Each finger is directed toward the center of the tube from the outer wall of the tube and is shaped to provide surfaces that abut the outer wall of an installed charge case. A first finger portion 138 is orthogonal to the axis of the tube and abuts the upright side wall of the illustrated charge case. Second and third portions 140, 142 of leg 130 are angled toward the center line 186 of the aperture, forming progressively smaller interior angles with the wall tube.

There is a second pair of fingers 144 in the second embodiment holder which fingers are located diametrically opposite the aperture and project into the tube. Fingers 144 are aligned with each other along a line 146 transverse to the tube axis and have distal ends shaped to mate with the exterior of the base of a charge case. A first portion 148 of the finger attached directly to the tube wall forms an approximately ninety degree angle with the tube wall. Second portion 150 of fingers 144 provide surfaces which engage the base of the case with which they are in abutting contact to provide support for the charge case. Internal angle 152 between the second portion of the finger and the tube wall is less than the angle of ninety degrees between the first portion 148 and the tube wall. The corresponding internal angle made between distal portion 154 of leg 144 and the tube wall is greater, to match the shape of the case.

Figure 8:
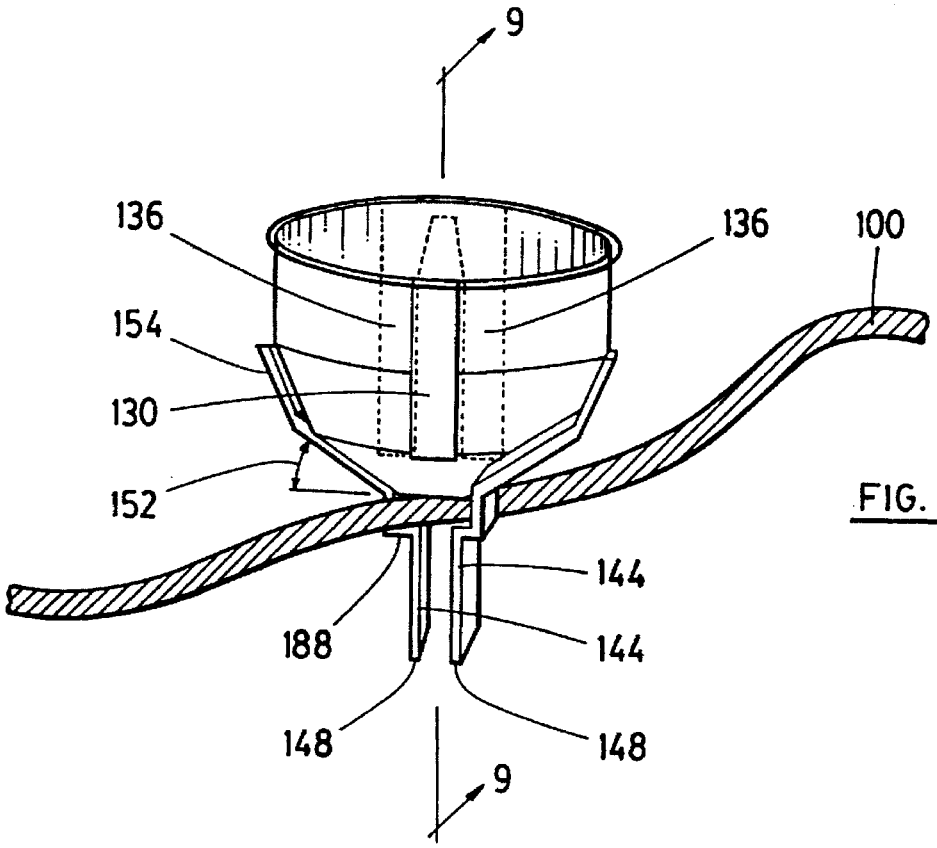
FIG. 8 is schematic detail of a second embodiment charge holder assembly.

Fingers 144 are further shaped so that detonation cord 100 can be inserted between the fingers in operable contact with the initiation material in the base of the charge case. Each finger 144 thus includes portion 188 spaced sufficiently from the bottom surface of the charge case to permit location of the detonation cord therein in operable contact with the initiator of the charge. FIG. 8 is a schematic diagram and in practice the gap as illustrated between finger portions 148 would likely be smaller in order that cord 100 would not be prone to slipping into the gap between the lowermost portions of fingers 144.

Additionally, the lowermost surface of the assembled case of the second embodiment is positioned such that it protrudes radially inwardly past the central axis 90 of the tube. With 135° phasing, nearest neighbor charges are rotated 135° with respect to each other and thus cord 100, when tensioned, or pulled taught after the charges have been secured in the holder can be pressed into tighter position against the initiator locations of the charges.

Figure 9:
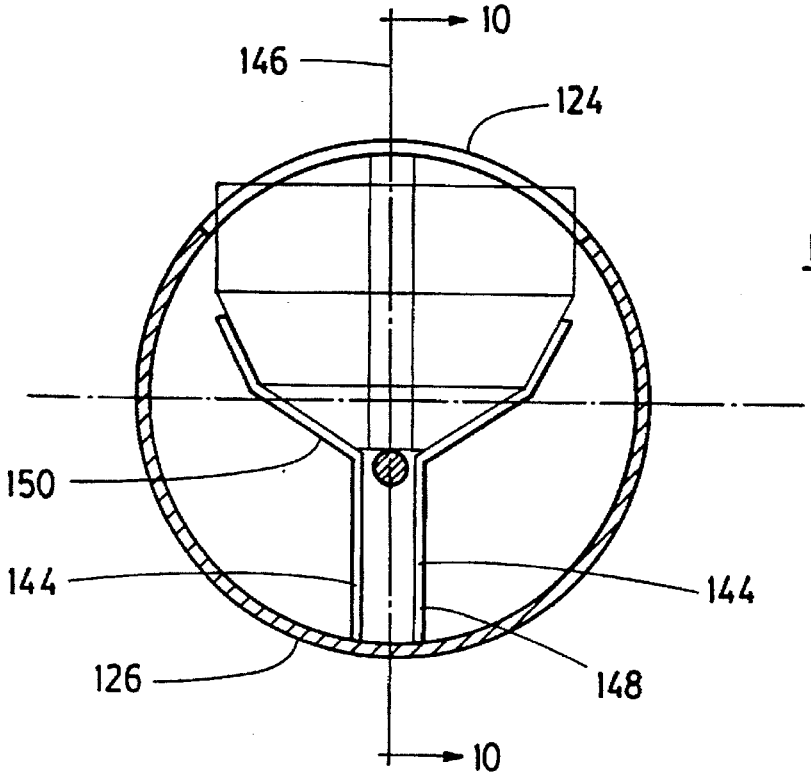
FIG. 9 is a simplified sectional view of the second embodiment holder taken along 9—9 of FIG. 8.
Figure 10:
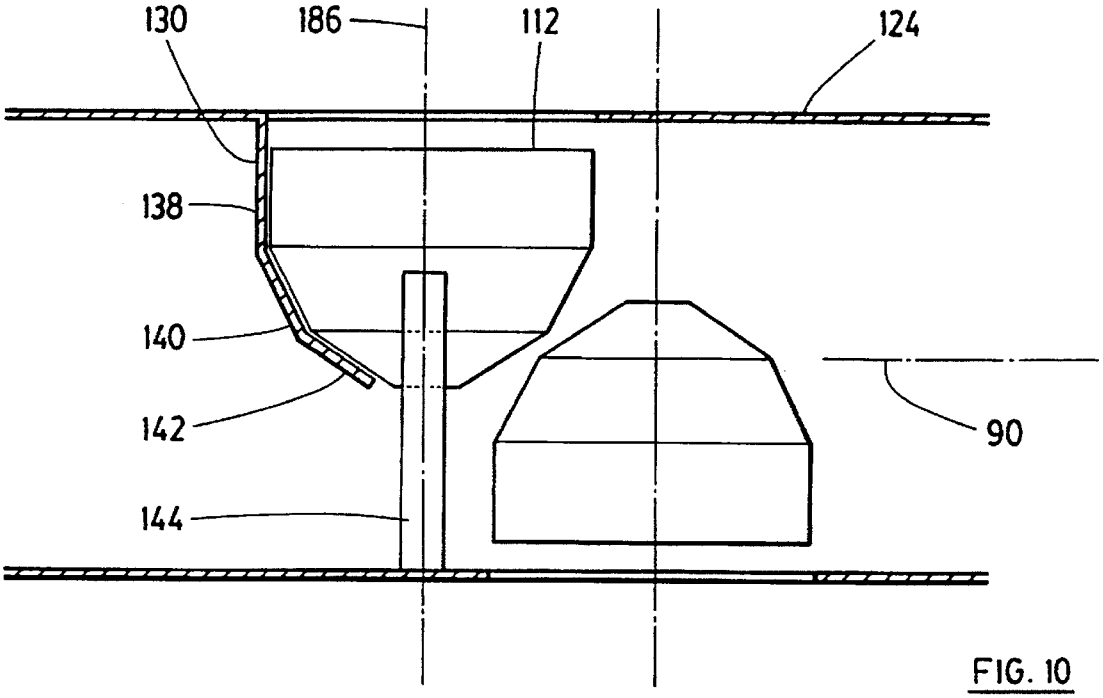
FIG. 10 is a simplified sectional view of the second embodiment holder taken along 10—10 of FIG. 9.

A pair of tabs 156, is used to hold the charge cases in the tube of the second embodiment holder. Each tab 156 is formed in the tube wall with one end 158 attached to the tube wall. The case is seated in the array of fingers 130, 136, 144 such that a middle portion of upper rim 112 of the case is located inside the tube as seen in FIG. 9. Geometrically speaking, the upper rim of the installed charge case is positioned intermediate the portion of the aperture edge lying on an aperture diameter line 134 parallel to the central axis 90 of the tube and the portion of the aperture edge lying on an aperture diameter line orthogonal to the axis of the tube. Tab 156 defines a portion 160 of the edge of aperture 162 of the second preferred embodiment and is located on the circumference of the aperture so that its free end can be bent into abutting contact with the upper rim 112 to affix the case against withdrawal from the tube. A screw driver or other suitable implement can be inserted into aperture 164 to bend each tab out of place as shown in FIG. 11 into abutment with upper edge 112 of a charge case to secure the case in the holder for use. It might be found that one such tab produces a satisfactory securement of the cases in a tube, or that more than two tabs are required.

In the case of the second embodiment, a charge density of 26 shots per meter is possible.

Figure 12:
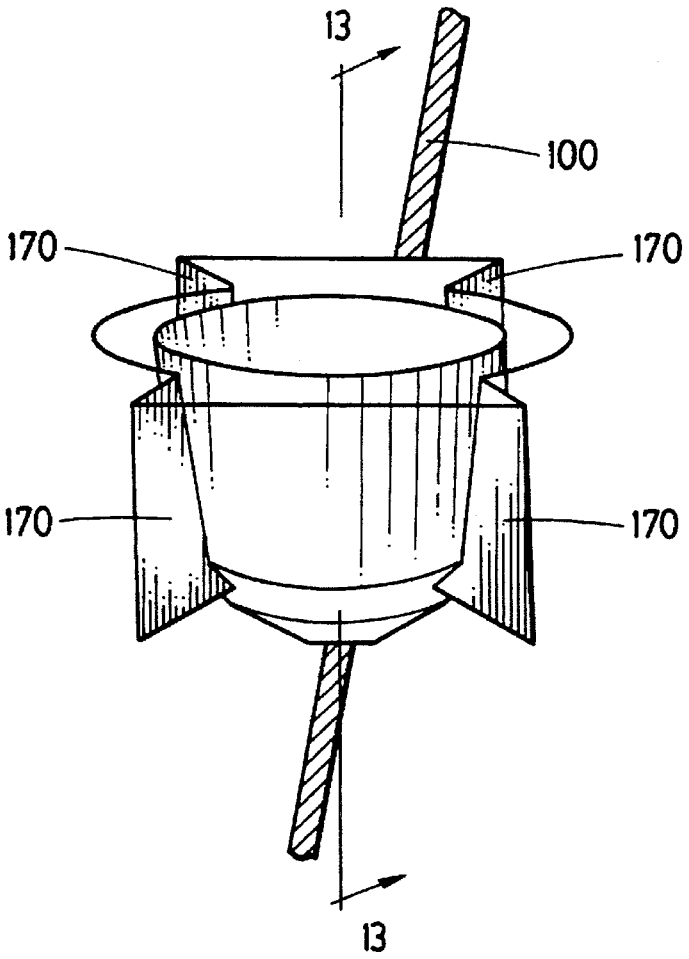
FIG. 12 is a schematic detail of a third embodiment charge holder assembly.
Figure 13:
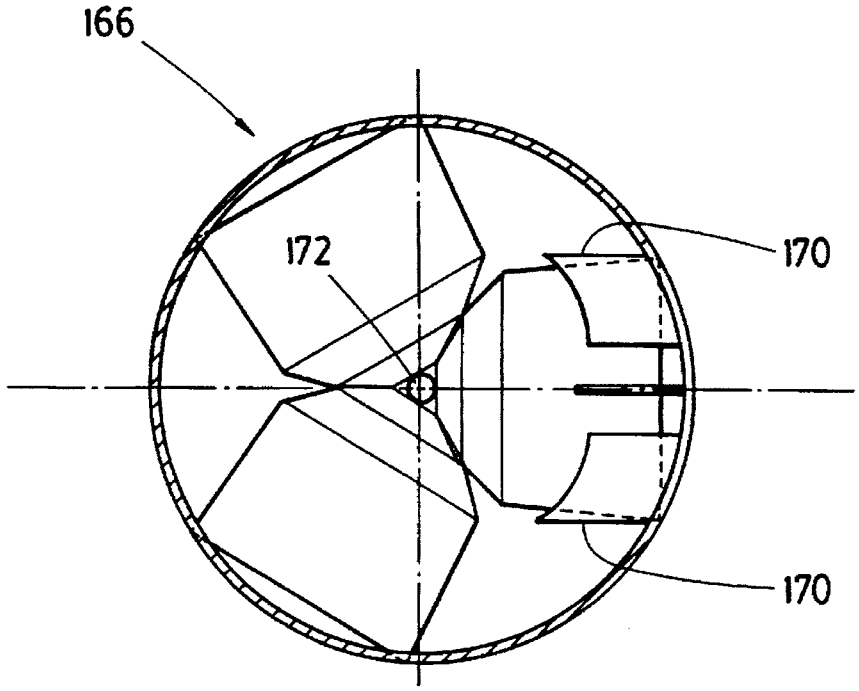
FIG. 13 is a is a simplified sectional view of the third embodiment holder assembly taken along 13—13 of FIG. 12.
Figure 14:
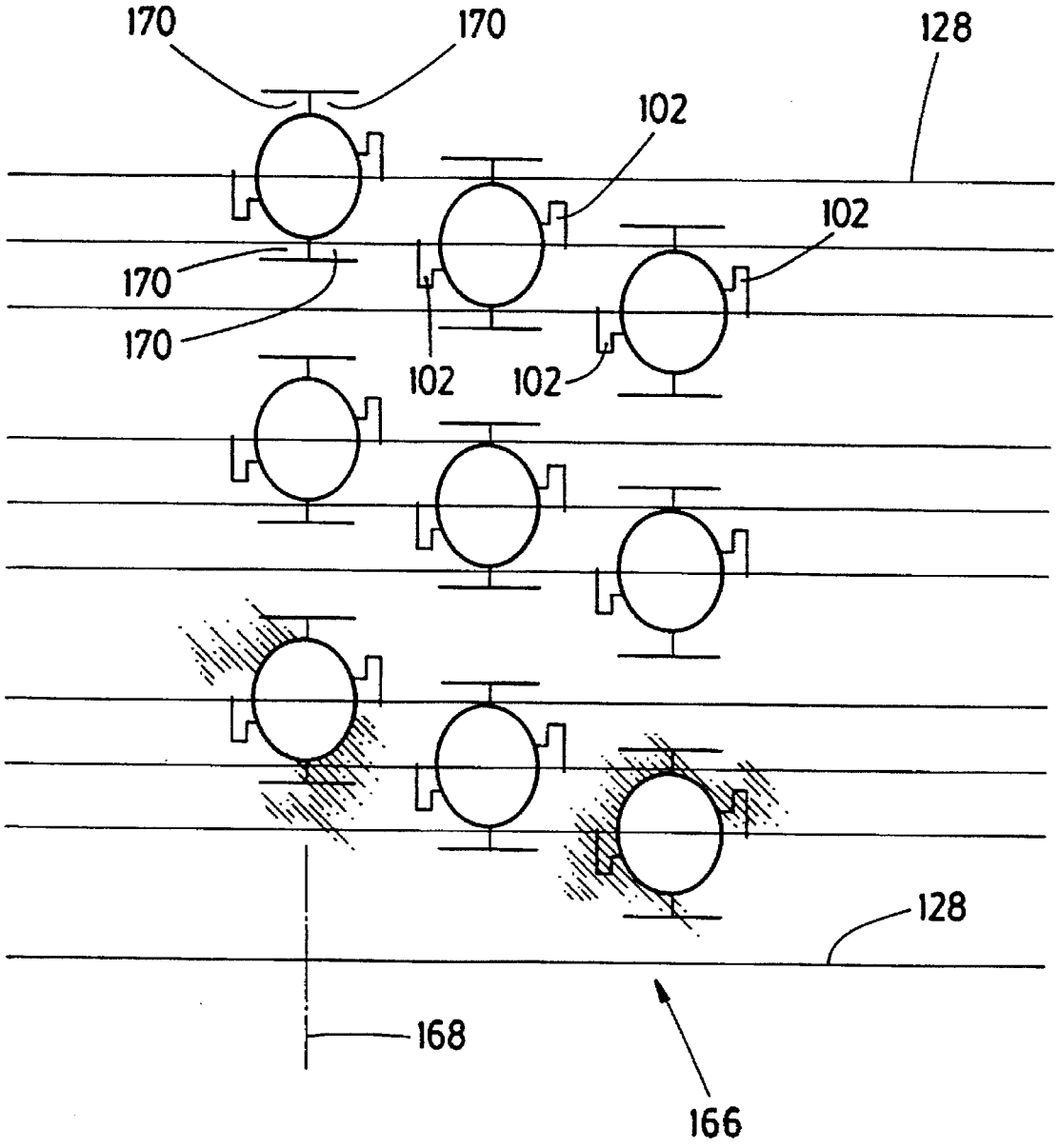
FIG. 14 is a representational projection of the third embodiment holder tube onto a flat surface.

A third embodiment holder 166 is illustrated in FIGS. 12 to 14. The circular tube of holder 166 has an outer diameter of about 10 cm (4 inches), the wall being about 0.17 cm (0.065 inches) thick. In this embodiment, three charge cases are arranged in the plane 168 of a single circle orthogonal to the axis of the charge case holder. The "triplets" of charges are phased at 60°. The axial distance between centers of axially spaced apertures is about 7.6 cm (3 inches). All of the fingers 170 supporting the charge case in the holder protrude into the tube interior from around the perimeter aperture. There are four fingers, two on either side of the aperture diameter line parallel to the axis of the tube. Tabs 102, described in connection with the first embodiment charge case holder, are used to secure the installed case against withdrawal radially outwardly from the center of the tube.

The initiators of the three charges in a triplet of the third embodiment are in close enough proximity to each other that it is sufficient to place detonation cord 100 in gap 172 between the bases of the cases to obtain operable contact between the initiators and the cord.

Figure 15:
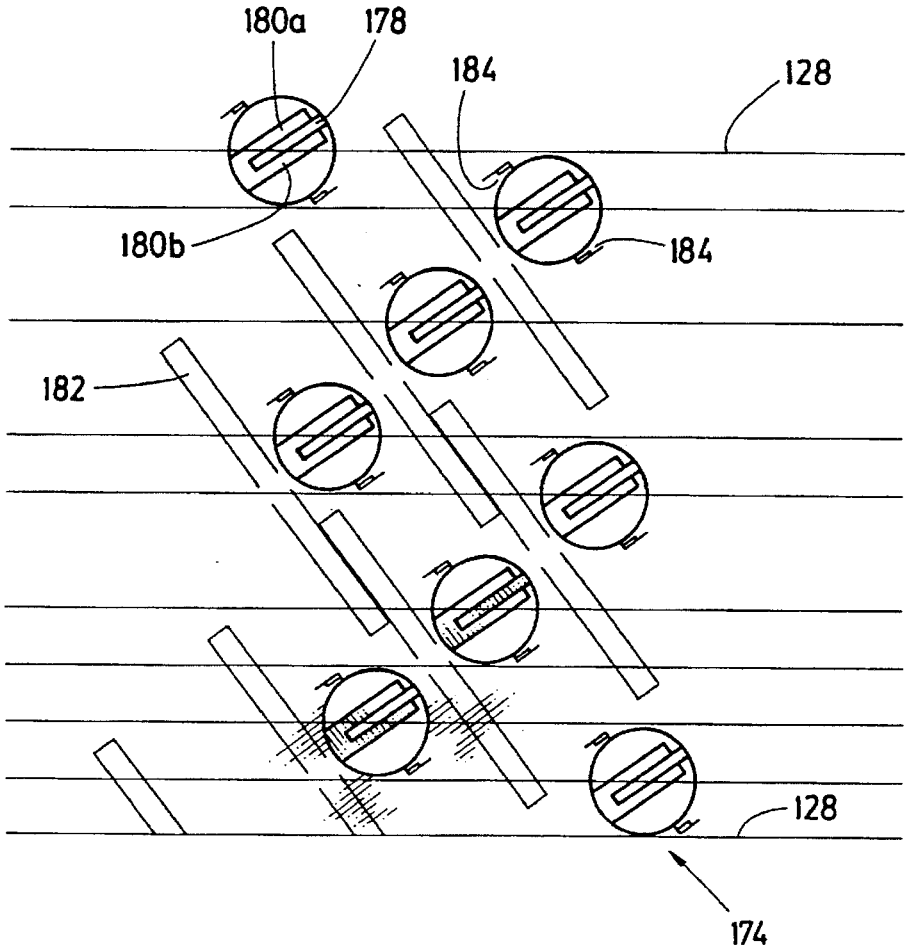
FIG. 15 is a representational projection of a fourth embodiment holder tube onto a flat surface.
Figure 16:
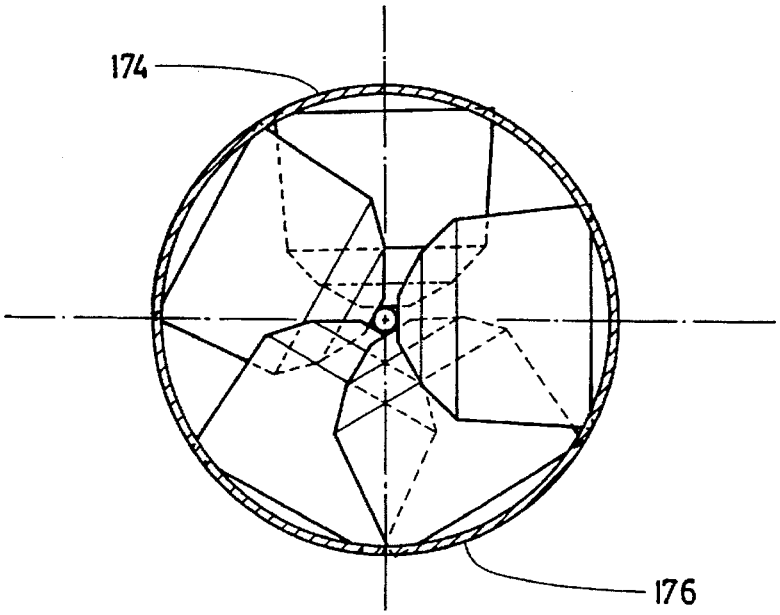
FIG. 16 is a simplified sectional end view of the fourth embodiment holder tube assembly showing the phasing of five charges in the tube.

A fourth embodiment holder 174 is illustrated in FIGS. 15 and 16. Tube 176 has the same dimensions as those of the third embodiment. In this embodiment there is an axial distance of about 2.5 cm (1 inch) between the centers of neighboring apertures. The phasing is 150°. Fingers 178, 180*a*, 180*b*, 182 (outline only of the last listed shown in FIG. 15) resemble fingers 130, 136*a*, 136*b*, 144, respectively, of the second embodiment although the orientation of the various elements with respect to the axis of the tube is different. Likewise, tabs 184 resemble tabs 156 of the second embodiment holder.

A charge density of 39 shots per meter is possible with either the third of fourth embodiment.

The charge case of the illustrated embodiments is cold formed, but the case could equally well be powdered metal formed, cast, or a case could be fiber material, glass, or a paper product.

It will thus be evident that, with the present invention, it is possible to obtain an expendable tubular charge holder in a range of charge densities and tube diameters, and a holder can be configured to hold charges having cases of a large variety of shapes and sizes. It is possible to obtain a charge holder assembly in which the charge case has no machined elements. A person skilled in the art would be able to alter the particular details of the emodiments of the invention described above. The scope of protection sought for the invention is defined in the claims which follow.

What is claimed is:

1. An expendable shaped charge holder assembly for a perforating gun, the assembly comprising:

a thin-walled tube having an aperture;

a shaped charge for installation in the tube by insertion through the aperture;

a plurality of fingers unitary with the tube wall protruding into the tube interior with surfaces which together define a cavity for receipt of the case of the charge therein and which engage the case when brought into abutting contact therewith to support the installed charge in the holder; and a tab unitary with the tube wall and having an end attached thereto, the tab being bendable by means of a hand-held tool into abutting contact with an upper rim of the case of the installed charge to affix the charge in the tube.

2. The assembly of claim 1 wherein the tube is of metal and the fingers are formed by laser cutting, plasma cutting, sand cutting, or punching of the tube wall.

3. The assembly of claim 2 wherein the tube is of extruded metal of substantially constant cross section.

4. The assembly of claim 3 wherein the tube is of substantially constant thickness.

5. The assembly of claim 1 wherein the tube has a longitudinal axis and there is a plurality of said apertures, spaced from each other.

6. The assembly of claim 1, further comprising a detonation cord, and wherein the fingers are shaped to locate the base of the charge case with respect to an interior wall of the tube to provide a gap therebetween for locating the detonation cord therein in a position with the cord in operable contact with the initiator of the charge.

7. The assembly of claim 6, wherein:

there is a plurality of said apertures spaced along an axis of the tube and a said plurality of fingers, a said tab and a shaped charge corresponding to each aperture; and points of attachment of the fingers to the tube wall of each plurality of fingers are spaced from each other and the fingers are oriented with respect to a central axis of the tube to provide a path located between the points of attachment of the fingers of each plurality of fingers oriented for stringing the detonation cord between neighboring charge locations.

8. The assembly of claim 7 wherein, the fingers are further shaped to locate the base of the charge such that when the tab is bent into abutting contact with the upper rim of the case the base of the case exerts compressive force on the cord to secure the cord in said position.

9. The assembly of claim 6 wherein, there are four said fingers, a first pair of which are aligned with each other, and a second pair of which are aligned with each other and form an angle of about 90° with the first pair.

10. The assembly of claim 9 wherein:

the tube is of circular cross section;

there is a plurality of said apertures and a said plurality of fingers, a said tab and a shaped charge corresponding to each aperture;

each of the apertures is shaped to matingly receive the corresponding shaped charge; and the fingers of each plurality of fingers are shaped to support the corresponding charge in a position with an upper rim of the case of the charge intermediate a portion of an edge of the aperture lying on an aperture diameter line parallel to a longitudinal axis of the tube and a portion of the aperture edge lying on an aperture diameter line orthogonal to the axis of the tube, and the corresponding tab has a first edge which defines an edge portion of the aperture and the tab is circumferentially located to permit bending of a free end of the tab into said abutting contact with the upper rim of the charge case.

11. The assembly of claim 10 wherein each charge case has a circular external transverse section and the base of the case has a surrounding wall slanted downwardly and inwardly, and each finger of each plurality of fingers has a distal portion, which distal portions together define surfaces to abut the wall of the base of the corresponding charge case.

12. The assembly of claim 11 in which each said finger has an intermediate portion connecting the distal portion to the tube wall, which intermediate portion forms a first internal angle with the tube wall, the distal portion forming second internal angle with the tube wall, wherein the first angle is greater than the second angle.

13. The assembly of claim 9, wherein:

the tab has an edge which defines an edge portion of the aperture;

the tab is located such that a rim portion of the installed charge case is intermediate the cavity and the point of attachment of the tab; and the unattached end of the tab has a notch located to permit a first edge of the tab defining the notch to be brought into abutting contact with the upper rim of the charge case when the tab is bent about its point of attachment towards a central axis of the tube so as to affix the charge case against radially outward movement with respect to the tube.

14. The assembly of claim 13 wherein a second edge of the tab is oriented to abut a side of the charge case when the first edge is in said abutting contact with the rim of the case.

15. The assembly of claim 14 wherein there are two said tabs corresponding to each aperture, each tab being located to have an end attached to the tube lying on a diameter line of the aperture parallel to the axis of the tube.

16. The assembly of claim 1, further comprising a detonation cord, and wherein the fingers are shaped to support the cord between the fingers and case so as to locate the cord in operable contact with the initiator of the charge.

17. The assembly of claim 16, wherein:

the tube has a central axis and there is a plurality of said apertures, the apertures being axially spaced apart along the tube and there being a said plurality of fingers corresponding to each aperture;

the fingers of each of the pluralities of fingers are shaped to hold the case received through the corresponding aperture in a position in which the base of the case protrudes radially inwardly past the axis of the tube and to permit a detonation cord to be inserted between the fingers and the initiator of charge; and the axial spacing of the apertures and phasing of the apertures is such that a cord can be so inserted between each plurality of fingers and the corresponding case to be strung between neighboring cases through the tube and tensioned into operable contact with the initiator of each charge.

18. The assembly of claim 17, wherein the case of each charge has a circular transverse outer cross section and each aperture is shaped to receive a said charge, first and second fingers of each plurality of fingers are located on diametrically opposite sides of the corresponding aperture and extend from an edge of the aperture into the tube.

19. The assembly of claim 18, wherein each said plurality of fingers includes third and fourth fingers, located in the tube diametrically opposite the corresponding aperture and projecting into the interior of the tube toward the aperture.

20. The assembly of claim 19 wherein, for each plurality of fingers, each first finger is located on an aperture diameter line parallel to the axis of the tube, and there are two said second fingers, one on either side of the first finger and on a line parallel to the aperture diameter line and the third and fourth fingers are aligned with each other on a line transverse to the tube axis to affix the charge case against movement in a direction transverse to the axis of the tube.

21. The Assembly of claim 16, wherein:

the plurality of fingers includes a pair of fingers located in the tube diametrically opposite the aperture and projecting into the interior of the tube toward the aperture;

each of the pair of fingers has a proximal end connected to the tube wall and a distal end for said abutting contact with the case of the charge; and a portion of each of the fingers, between the distal and proximal ends of the finger, together with the portion of the other finger and with a lower surface of the installed charge case, defines a gap for receipt of the cord therethrough to locate the cord in said operable contact with the initiator of the charge.

22. The assembly of claim 21 wherein the portion of each finger includes a surface spaced from the lower surface of the charge case.

23. The assembly of claim 1, wherein the tube is of circular cross section, the aperture is shaped to receive a charge having a case with a transverse circular cross section such that an upper rim of the installed charge case is positioned intermediate the portion of the aperture edge lying on an aperture diameter line parallel to the axis of the tube, and the portion of the aperture edge lying on an aperture diameter line orthogonal to the axis of the tube, and there is at least one said tab having an edge which defines an edge portion of the aperture and which is circumferentially located to permit bending of a free end of the tab inwardly toward the center of the aperture into said abutting contact with the upper rim of the charge case.

24. The assembly of claim 23 wherein there is an aperture between the tab and the tube wall to permit insertion of a screw driver therein for bending the tab into said abutting contact with the upper rim of the case.

25. The assembly of claim 1, wherein:

the tube has a central axis, and the tube is dimensioned and the fingers shaped such that at least a portion of an upper rim of the case of the installed charge is located radially inward of the tube wall;

the tab has a free end; and the tab is located to permit a first edge of the free end to be brought into said abutting contact with the upper rim of the charge case when the free end of the tab is bent towards the center of the tube.

26. The assembly of claim 25, wherein:

the free end of the tab has a second edge oriented to abut a side of the charge case when the first edge is in said abutting contact with the rim of the case.

27. The assembly of claim 1, wherein:

the tube is of circular cross section and has a central axis;

there is a plurality of said apertures and a said plurality of fingers, a said tab and a shaped charge corresponding to each aperture;

each of the apertures is shaped to matingly receive the corresponding shaped charge; and the fingers of each plurality of fingers are shaped to support the corresponding charge in a position with an upper rim of the case of the charge intermediate a portion of an edge of the aperture lying on an aperture diameter line parallel to the axis of the tube and a portion of the aperture edge lying on an aperture diameter line orthogonal to the axis of the tube, and the corresponding tab has a first edge which defines an edge portion of the aperture and the tab is circumferentially located to permit bending of a free end of the tab into said abutting contact with the upper rim of the charge case.

28. The assembly of claim 27, wherein:

an unattached end of each said tab defines a notch including the first edge and the first edge is located to be brought into said abutting contact with the upper rim of the charge case when the tab is bent about its point of attachment to the tube wall towards a central axis of the tube.

29. The assembly of claim 28 wherein each notch of a said tab includes a second edge oriented to abut a side of the charge case when the first edge is in said abutting contact with the rim of the case.

30. The assembly of claim 29 wherein the point of attachment of each said tab lies on a diameter line of the aperture parallel to the axis of the tube.

31. The assembly of claim 30 wherein there are two said tabs corresponding to each aperture.

32. The assembly of claim 1, further comprising:

a detonation cord; and wherein, the tube has a central axis and three said apertures circumferentially spaced from each other and lying in a common plane orthogonal to the axis; and there is a said plurality of fingers corresponding to each aperture, the fingers of each plurality shaped to support a corresponding said installed charge in the holder such that the charges are spaced from each other to provide a gap between the bases of the cases for receipt of the detonation cord into the gap and in operable contact with the initiators of the three cases.

33. The assembly of claim 32 wherein:

the tube is of circular cross section;

each of the apertures is shaped to matingly receive the corresponding shaped charge;

the diameter of the tube is dimensioned and the fingers of each plurality of fingers are shaped to support the charge corresponding to each aperture in a position with an upper rim of the case of the charge intermediate a portion of an edge of the aperture lying on an aperture diameter line parallel to the axis of the tube and a portion of the aperture edge lying on an aperture diameter line orthogonal to the axis of the tube, and the corresponding tab has a first edge which defines an edge portion of the aperture and the tab is circumferentially located to permit bending of a free end of the tab into said abutting contact with the upper rim of the charge case.

34. The assembly of claim 1 wherein the charge is affixed in the tube without relying on a machined portion of the case of the charge.

35. The assembly of claim 1 wherein the case of the charge is cold formed metal, formed of powdered metal, cast metal, fiber material, glass, or a paper product and the case is manufactured free of machined portions.

36. The assembly of claim 35 wherein the case is cold formed metal.

37. An expendable shaped charge holder assembled with shaped charges for use as part of a perforating gun comprising:

a thin-walled metal tube having an aperture;

a shaped charge received in the tube through the aperture;

a plurality of fingers unitary with the tube wall protruding into the tube interior with surfaces which together define a cavity in which an outer case of the charge is seated and which are in abutting contact with the case to engage the case and support the charge installed in the holder; and a tab unitary with the tube wall and having an end attached thereto, a surface of the tab being in abutting contact with an upper rim of the case of the installed charge to affix the charge in the tube.

* * * * *